United States Patent [19]

Dwyer

[11] Patent Number: 4,553,603

[45] Date of Patent: Nov. 19, 1985

[54] REPLACEABLE DEFLECTORS FOR THE SPRINKLER HEADS OF AUTOMATIC FIRE EXTINGUISHING SYSTEMS

[76] Inventor: John J. Dwyer, 22 Grove Ave., Randolph, Mass. 02368

[21] Appl. No.: 685,956

[22] Filed: Dec. 24, 1984

Related U.S. Application Data

[63] Continuation-in-part of Ser. No. 447,534, Feb. 24, 1983, abandoned.

[51] Int. Cl.[4] ..... A62C 37/08

[52] U.S. Cl. ..... 169/38; 169/37; 169/42; 239/505; 239/600

[58] Field of Search ..... 169/37–42, 169/90; 239/390, 505, 600

[56] References Cited

U.S. PATENT DOCUMENTS

| | | | |
|---|---|---|---|
| 1,253,019 | 1/1918 | Fee | 239/42 |
| 1,904,828 | 4/1933 | Green | 169/39 |
| 3,273,805 | 9/1966 | Hall | 239/600 |
| 3,446,286 | 5/1969 | Kreidler | 169/38 |

FOREIGN PATENT DOCUMENTS

| | | | |
|---|---|---|---|
| 2225215 | 12/1972 | Fed. Rep. of Germany | 169/38 |

*Primary Examiner*—Andres Kashnikow
*Assistant Examiner*—James R. Moon, Jr.

[57] ABSTRACT

This invention is directed at a sprinkler head for automatic fire extinguishing systems having deflectors that are replaceable. The deflectors may be replaced, while the head is installed in an active system, without shutting the system down.

2 Claims, 8 Drawing Figures

REPLACEABLE DEFLECTORS FOR THE SPRINKLER HEADS OF AUTOMATIC FIRE EXTINGUISHING SYSTEMS

This is a continuation-in-part of co-pending application Ser. No. 447,534 filed on 2/24/83, now abandoned.

BACKGROUND OF THE INVENTION

This invention relates to fire protection systems, more specifically, to an improved sprinkler head for use in automatic sprinkler systems.

Heretofore, various forms of sprinkler heads have been proposed for use in sprinkler systems all of which have included fixed deflectors. Examples of such prior art sprinkler heads may be found in the U.S. Pat. Nos. 4,136,740 to Groos et al issued Jan. 30, 1979; to Vorkapich, 3,498,383 issued Mar. 3, 1970; to Storer Ser. No. 531,228 filed 9-12-83 and to Anderson U.S. Pat. No. 4,117,887 issued Oct. 3, 1978.

SUMMARY OF THE INVENTION

The improved sprinkler head according to the present invention includes an easily removed deflector. In the specific embodiment disclosed, the deflector is engaged to an externally threaded pintle by a nut.

This is invention discloses a sprinkler head comprising a body portion, a nozzle, a thermally responsive element, a pintle, a seal element and a deflector, the thermally responsive element having a first terminal end and a second terminal end, the second terminal end spaced from the first terminal end, the deflector removeably attached to the pintle, the pintle engaged with the body portion and with the first terminal end of the thermally responsive element, the seal element positioned with the nozzle and engaged by the second terminal end of the thermally responsive element.

BRIEF DESCRIPTION OF THE DRAWING(S)

Further details are explained below with the help of the example illustrated in the attached drawing in which.

DESCRIPTION OF THE PREFERRED EMBODIMENT(S)

Figure 1:
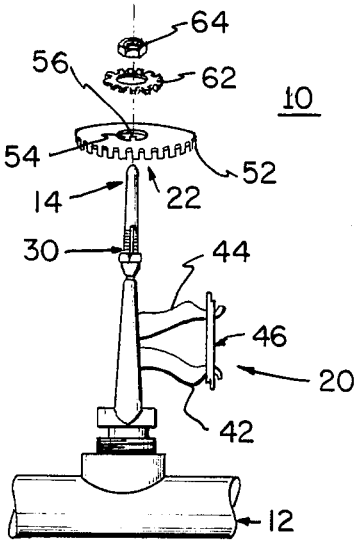
FIG. 1 is a front elevational, partially exploded view of an upright deflector sprinkler head according to the present invention.

There is shown in the drawings a sprinkler head 10 and a pipe 12. The sprinkler head 10 comprising a pintle 14, a connector 16, a body portion 18, a thermally responsive element 20 and a deflector or distributor 22.

The one piece pintle 14 is formed of an alloy of brass and copper, for example and has the configuration of a cylinder tapered at both its ends. A portion of the center portion and first end 24 of the pintle 14 is externally threaded and the center portion has an external, longitudinally extending groove 26 formed therein, for a purpose to be setforth hereinafter. A circular engagement portion 28 is integral with and forms a longitudinal continuation of the center portion of the pintle 14. The engagement portion 28 has a longitudinal slot 30 formed in its external surface as shown in FIG. 1. The slot 30 is aligned with and forms an extension of the groove 26. An annular shoulder portion 31 extends from the the junction of the threaded first end 24 and the engagement portion 28 in right angle relationship to the longitudinal axis of the pintle 14. The shoulder portion 31 has a greater diameter than the engagement portion 28 as shown in FIG. 1.

The connector 16 includes an axially, through, internally threaded tubular passage 32, defined by a tapering terminal portion 34.

The body portion 18 comprises a substantially oval yoke 36 having a through aperture 38 formed at one narrow end and a nozzle 40 engaged within an opening at the other end in opposed, spaced relation to the through aperture 38.

The conventional thermally responsive element 20 comprises a female lever 42, male lever 44 and a fusible link assembly 46 that includes material that is fusable on the application of a predetermined amount of heat. The female lever 42 has an extending tang portion or second terminal end 47 and the male lever 44 has an extending tang or first terminal end 48.

Figure 2:
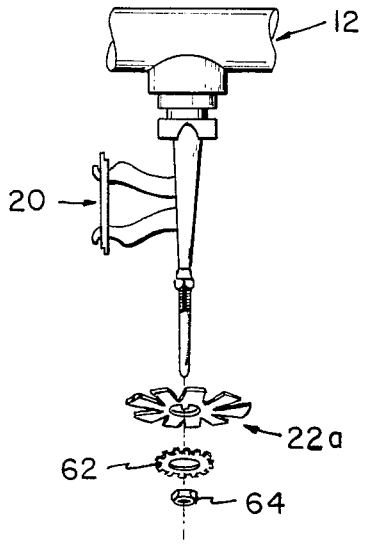
FIG. 2 is a front elevational, partially exploded view of a pendant deflector sprinkler head according to the present invention.
Figure 3:
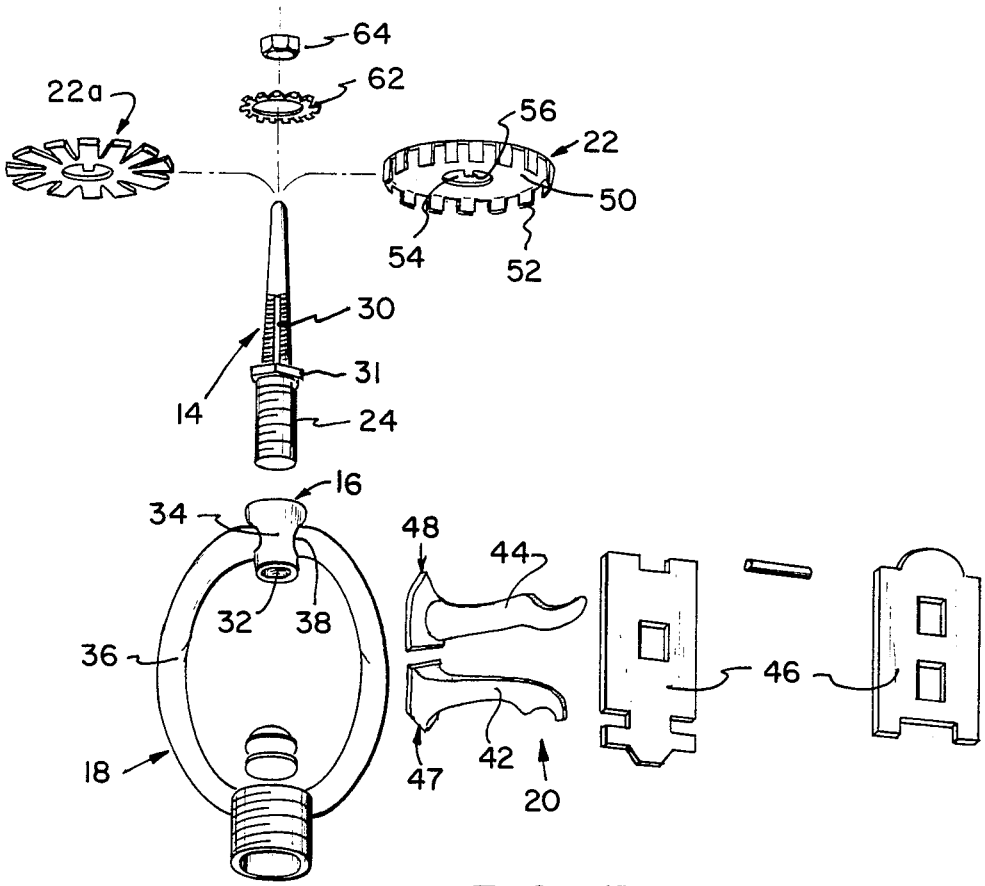
FIG. 3 is an exploded, enlarged perspective view of a sprinkler head, showing both pendant and upright deflectors.
Figure 4:
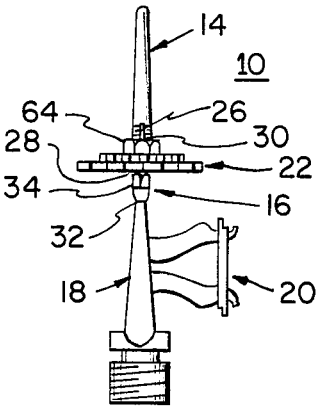
FIG. 4 is a side elevational view of an upright sprinkler head according to the present invention.
Figure 5:
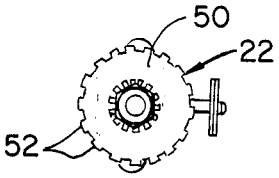
FIG. 5 is a top plan view of the sprinkler head shown in FIG. 4.
Figure 6:
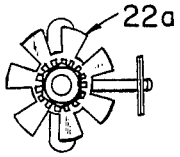
FIG. 6 is a bottom plan view of a pendant deflector sprinkler head according to the present invention.
Figure 7:
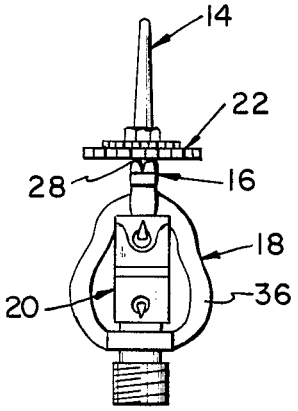
FIG. 7 is a front elevational view of the sprinkler head shown in FIG. 4.
Figure 8:
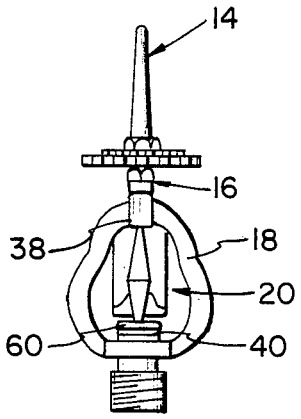
FIG. 8 is a rear elevational view of the sprinkker head shown in FIG. 4.

The deflector 22 disclosed in the drawing, at FIG. 1, is an upright deflector although a pendant, sidewall or horizontal sidewall deflector 22*a*, as shown in FIG. 2, could be utilized if desired. The deflector 22 comprises, the external configuration, a generally spherical or disk like body 50 in external configuration having a series of teeth or flanges 52 spaced from each other and extending downwardly from the circumferential periphery of the body 50. The body 50 has a wall defining a centrally positioned, through hole 54 and has a key element 56 integral with the wall and extending, a predetermined distance, toward the center of the hole 54.

To assemble the sprinkler head 10, the terminal portion 34 of the connector 16 is press fitted into the through aperture 38 of the body portion 18. The externally threaded first end 24 of the pintle 14 is threaded into the passage 32 of the connector 16 until the lower surface of the shoulder portion 31 bears against the connector 16. The shoulder portion 31 is wider at its widest horizontal plane than the connector 16. A predetermined portion of the first end 24 extends into the area defined by the yoke 36 of the body portion 18. The first end 24 is engaged with the tang or first terminal end 48 of the male lever 44 of the thermally responsive element 20 while the tang portion or second terminal end 47 of the female lever 42 of the thermally responsive element 20 is engaged to a cap or seal element 60 which engagres with and closes off the nozzle 40 of the body portion 18, since the opposite end of the tang 48 and the tang portion 47 engage each other and are held in moveable engagement by a toggle pin (not shown), the free ends of the female and male levers 42, 44 can be connected by engaging them with the link assembly 46 in a manner well known in the art. The terminal end of the pintle 14 remote from the first end 24 is passed through the hole 54 of the deflector 22 with the key element 56 of the deflector 22 aligned and moved within the groove 26 and the slot 30 until the deflector 22 bears against the upper surface of the annular shoulder portion 31. A retainer washer 62 is then engaged around the pintle 14 against deflector 22 and is held in place, against the deflector, by a nut 64 which is threaded onto the external threads of the first end 24 of the pintle 14. The shoulder portion 31 is positioned in superposed, abutting relation to the connector 16.

What I claim is:

1. A sprinler head of the automatic type comprising a body portion, a nozzle, a thermally responsive element, a pintle, a seal element, a connector and a deflector, the thermally responsive element having a first thermal end and a second terminal end spaced from the first terminal end, the deflector removeably attached to the pintle, the connector engaged to the body portion and the pintle engaged to the body portion through the connector and with the first terminal end of the thermally responsive element, the seal element positioned with the nozzle and engaged by the second terminal end of the thermally responsive element, the connector including an internally threaded axial bore, and the pintle having a first externally, threaded end, a second end, a free end and a center portion, the center portion includes a threaded portion and an unthreaded engagement portion, an annular shoulder portion extending from the junction of the first end and the engagement portion in right angle relationship to the longitudinal axis of the pintle, the shoulder portion having a greater diameter than the engagement portion, the free end threaded into the axial bore of the connector and the deflector attached to the externally threaded center portion of the pintle by a nut and the shoulder portion positioned between the deflector and the connector.

2. A sprinkler head of the automatic type comprising a body portion, a nozzle, a thermally responsive element, a pintle, a seal element, a connector and a deflector, the thermally responsive element having a first terminal end and a second terminal end spaced from the first terminal end, the deflector removeably attached to the pintle, the pintle engaged with the body portion and with the first terminal end of the thermally responsive element, the connector engaged to the body portion, and the pintle engaged to the body portion through the connector and with the first terminal end of the thermally responsive element, the connector engaged to the body portion including an internally threaded axial bore and the pintle having a free end, the free end threaded into the axial bore of the connector, the seal element positioned with the nozzle and engaged by the second terminal end of the thermally responsive element, the pintle further including a vertical groove, an annular shoulder portion and having an engagement portion extending upwardly from the shoulder portion, the engagement portion having a vertical slot formed therein, the slot providing an extension of the groove, the deflector having a wall defining a centrally positioned through aperture, a key extending from the wall into the aperture and engageable in the groove of the pintle when the pintle is engaged in the connector.

* * * * *